United States Patent [19]

Saul

[11] 3,969,691

[45] July 13, 1976

[54] MILLIMETER WAVEGUIDE TO MICROSTRIP TRANSITION

[75] Inventor: David L. Saul, El Cajon, Calif.

[73] Assignee: The United States of America as represented by the Secretary of the Navy, Washington, D.C.

[22] Filed: June 11, 1975

[21] Appl. No.: 586,113

[52] U.S. Cl. ..... 333/21 R; 333/34; 333/98 M

[51] Int. Cl.[2] ..... H01P 1/16

[58] Field of Search ..... 333/21 R, 33, 26, 34, 333/84 M, 98 M

[56] References Cited

UNITED STATES PATENTS

| | | | |
|---|---|---|---|
| 2,825,876 | 3/1958 | LeVine et al. | 333/84 M |
| 2,979,676 | 4/1961 | Rueger | 333/84 M X |
| 3,462,713 | 8/1969 | Knerr | 333/21 R |

*Primary Examiner*—Paul L. Gensler
*Attorney, Agent, or Firm*—R. S. Sciascia; G. J. Rubens; H. Fendelman

[57] ABSTRACT

A waveguide to microstrip transition apparatus in which a waveguide coupled to a microstrip circuit is provided with a mode filter for suppressing spurious modes of electromagnetic signal propagation. The mode filter is attached to the end of the waveguide that is coupled to the microstrip circuit and the mode filter extends over a portion of the microstrip circuit.

4 Claims, 3 Drawing Figures

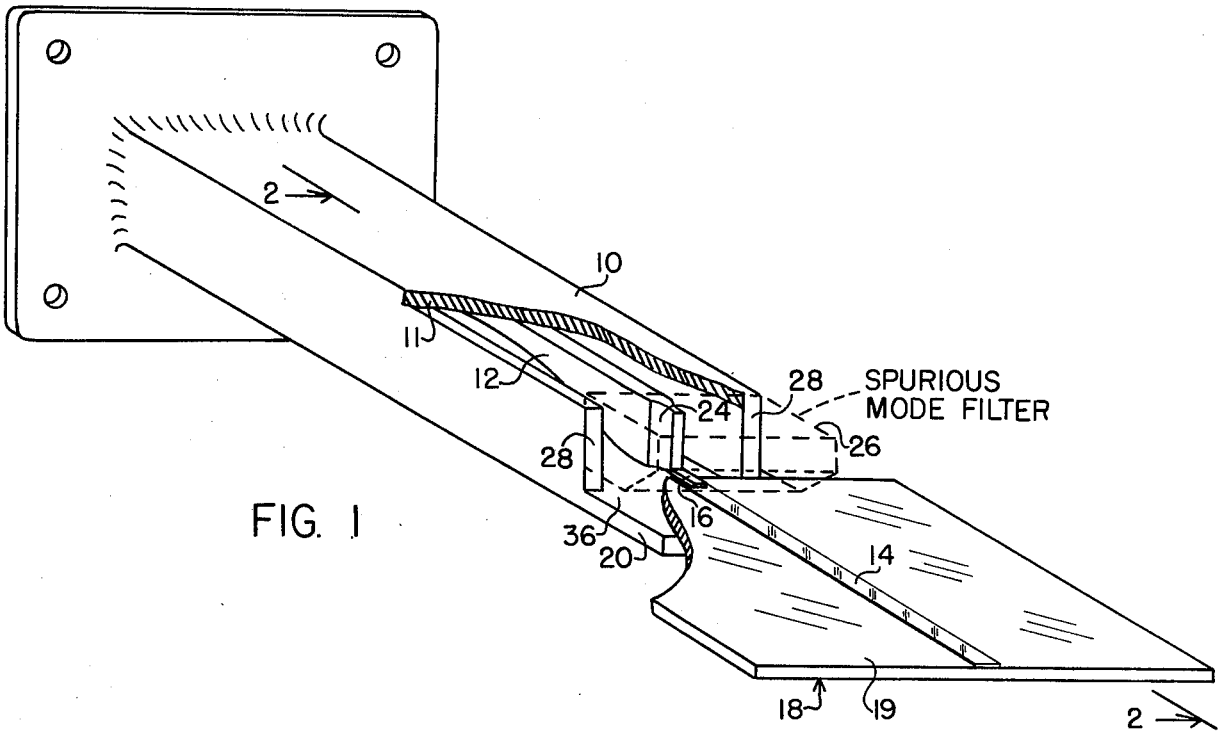
FIG. 1
FIG. 2
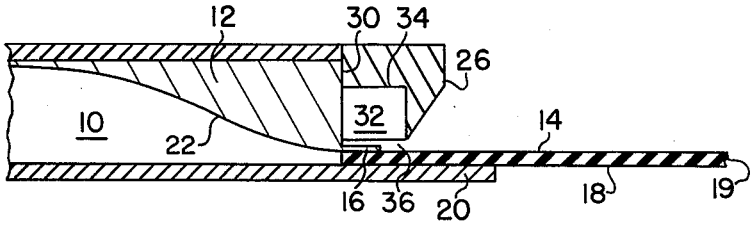
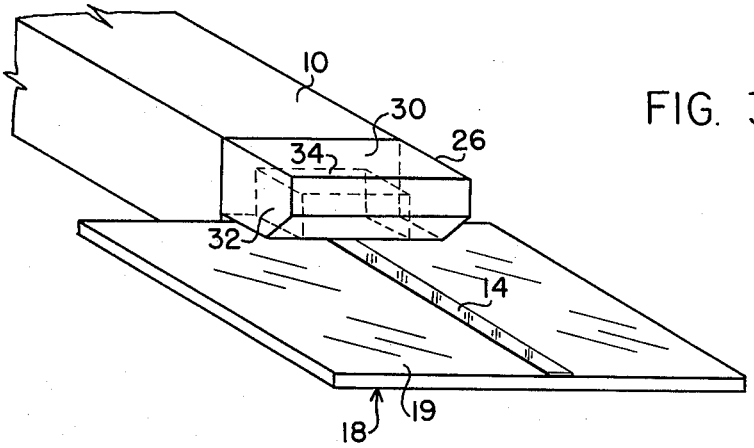
FIG. 3

MILLIMETER WAVEGUIDE TO MICROSTRIP TRANSITION

BACKGROUND OF THE INVENTION

The structure of microstrip circuit media as a whole, most notably the arrangement of a planar dielectric substrate and ground plane, has the physical character of a grounded dielectric slab. The latter is well known to be capable of supporting a large variety of surface wave modes of electromagnetic signal propagation. Some of these modes can be suppressed in microstrips simply by choosing a substrate sufficiently thin so as to be beyond the natural cut-off wavelength of certain particular modes. Not all spurious modes, however, can be suppressed by such a technique. Thus, in spite of observing such precautions, spurious modes still tend to be excited, particularly at higher frequencies. When loosely coupled to the circuit medium, these modes tend to give rise to direct signal radiation. Radiation of this sort is highly undesirable both from a standpoint of increased insertion loss and the possibility of undesired coupling to other circuit elements.

Older types of waveguide to microstrip transitions capable of wideband operation do not contain any specific provision for suppression of spurious surface wave modes which tend to become particularly problematical at millimeter wavelengths. Certain other transition apparatus designs which are inherently less susceptible to excitation of spurious modes because of their physical configuration, e.g., a containing probe or loop connected to an intermediate structure supporting a pure TEM mode, contain frequency sensitive circuit elements which restrict their bandwidth to considerably less than that attainable with the ridgeline transformer section used in the present invention. In terms of available performance, earlier types of transition apparatus fail to combine wideband capability with low VSWR and low insertion loss throughout a broad band of frequencies as permitted by the present invention.

SUMMARY OF THE INVENTION

The present invention provides an improved means of transferring guided electromagnetic signals from a dominant mode rectangular waveguide to a microstrip transmission line, capable of operation at frequencies extending into the millimeter wave region. The present invention permits wideband operation with high efficiency performance as is evidenced by the low VSWR and low insertion loss, over at least a 3:2 band of frequencies, i.e., over at least a full standard waveguide frequency band. This invention is suitable for operation not only in the 26.5 to 40 GHz frequency band but also can be designed to operate at higher or lower bands.

Any mode of electromagnetic signal propagation beyond the interior of the waveguide structure other than the quasi-TEM mode characteristic of microstrip circuit media is defined herein to be a spurious mode. Signal power converted to and propagated in such a mode is generally lost, becoming a constituent part of insertion or transmission loss. The present invention relates to a special mode filter incorporated to prevent signal losses arising from excitation of one or more spurious modes in the microstrip circuit medium. The present invention thus prevents radiation into free space and directs all the waveguide energy onto the microstrip medium and also prevents reflections back into the waveguide.

STATEMENT OF THE OBJECTS OF THE INVENTION

It is the primary object of the present invention to disclose a novel waveguide to microstrip transition apparatus.

It is another object of the present invention to disclose a novel mode filter for suppressing spurious propagation modes.

Other objects, advantages and novel features of the present invention will become apparent from the following detailed description of the invention when considered in conjunction with the accompanying drawings.

BRIEF DESCRIPTION OF THE DRAWINGS

FIG. 1 is an illustration of a waveguide coupled to a microstrip circuit section illustrating in phantom the mode filter of the present invention. The upper waveguide wall and microstrip medium are illustrated as cut-away for clarity.

FIG. 2 is a sectional view of the present invention taken along the plane 2—2 of FIG. 1.

FIG. 3 is a perspective of the waveguide, microstrip medium and mode filter according to the present invention with the waveguide interior elements omitted for clarity.

DESCRIPTION OF THE PREFERRED EMBODIMENT

Referring now to FIGS. 1, 2 and 3 a dominant mode rectangular waveguide 10, illustrated as partially cutaway at 11 for clarity, contains a ridgeline transformer section 12 for matching the impedance of the waveguide input to the microstrip circuit 14 and for providing a wideband conversion from the waveguide dominant mode of propagation to the mode of propagation of the microstrip circuit 14, i.e., the quasi-TEM mode. Electrical connection to the microstrip line 14 is made by the tab connector 16 extending from the end of the ridgeline transformer section 12 as illustrated. The microstrip ground plane 18, which is bonded to dielectric 19, is physically positioned so as to form a continuation of the waveguide's lower conductive inner wall as illustrated and abuts against extension 20. The ground plane is also connected electrically to the lower conductive inner wall. The ridgeline transformer section 12 preferably is designed with a $\pi$ radian cosine taper 22 of sufficient length to permit operation over the desired frequency band, i.e., approximately four to five free space wavelengths for a 3:2 frequency band. The end 24 of the ridgeline section 12 containing the connector tab 16 is chamfered, as illustrated, to avoid the effect of the capacitive discontinuity in the region of the connector tab 16.

Nearly all the fields propagating along waveguide 10 are concentrated around and underneath the lower portion of ridge 12 and, without the mode filter of the present invention, would radiate to some degree from the vicinity of tab 16.

The mode filter 26 is specifically provided to counteract the adverse effects of spurious mode phenomenon. As seen in FIGS. 1, 2, and 3, the mode filter 26 is attached at the outer edge 28 of the waveguide 10 and extends outwardly therefrom, over the connector tab 16 and a portion of the microstrip line 14. The mode filter 26 includes a conductive back wall 30 which closes off a portion of the open end of the waveguide 10 and a microwave cavity 32 tuned beyond cut-off and situated above the microstrip line 14 in the region of the connector tab 16. The portion of the upper wall 34 of the cavity 32 located directly above the connector tab 16 is positioned approximately $\lambda/4$ away from the connector tab 16 where $\lambda$ is the free space wavelength at midband. The dimensions of the cavity 32 should be such that it cannot support resonance at the device operating frequency, i.e., such that it does not act as a resonant cavity, and should be sufficiently large such that the conductive walls of the mode filter 26 do not substantially interfere with the electromagnetic wave propagating on the microstrip line. The shape of the cavity interior is not a critical design factor and although a rectangular box-shape has been illustrated it is to be understood that other shapes such as cylindrical or spherical may also be used. A sufficiently large opening 36 must be provided, however, for the microstrip line 14 to pass through without disruption of the fields associated with the normal (quasi-TEM) mode of propagation along the microstrip line 14. Although some minimal influence on circuit impedance may be noted, the mode filter 26 is not primarily an impedance matching device, the impedance matching function being performed by the ridgeline transformer section 12.

The waveguide to microstrip transition apparatus of the present invention combines the performance advantages of wideband operation, low VSWR, and low insertion loss to an extent not attainable with earlier types of waveguide to microstrip transitions. Insertion loss in particular is reduced substantially through incorporation of the novel mode filter of the present invention. The mode filter of the present invention does not substantially interfere with the normal quasi-TEM mode of propagation in the microstrip line and is an effective means of suppressing spurious modes in the microstrip circuit medium. The mode filter can be fabricated in a variety of ways, including any of variously shaped, partially enclosed conductive cavities, i.e., cylindrical, spherical, or elliptical. A suitable dielectric structure may also be employed in lieu of the conductive cavity, or a filter consisting of a combination of dielectric and conductive materials may also be used. The ridgeline transformer section 12 may be fabricated in accordance with any of several possible ridgeline transformer design techniques including, but not necessarily limited to stepped ridge designs based on Chebychev or binomial techniques, linear ramp, and designs based on any of various transcendental mathematical functions.

Obviously many modifications and variations of the present invention are possible in the light of the above teachings. It is therefore to be understood that it is within the scope of the appended claims that the invention may be practiced otherwise than as specifically described.

What is claimed is:

1. A waveguide to microstrip transition apparatus comprising:
   - a waveguide;
   - a section of microstrip circuit coupled to said waveguide; and
   - mode filter means connected to said waveguide and extending over a portion of said section of microstrip circuit for preventing spurious modes of propagation beyond said waveguide, said mode filter means comprising a partially enclosed conductive cavity having an opening facing said portion of said section of microstrip circuit, said opening extending over said section of microstrip circuit.

2. The apparatus of claim 1 wherein:
   - said waveguide is a rectangular waveguide including a ridgeline transformer section;
   - said ridgeline transformer section being chamfered at one end;
   - a tab connected to said chamfered end;
   - said section of microstrip circuit being coupled to said waveguide by said tab; and
   - said partially enclosed conductive cavity extending over said tab.

3. The apparatus of claim 2 wherein said conductive cavity is sufficiently large to permit the radiation of energy from said tab without interference and sufficiently small to prevent resonance of the energy radiating from said tab.

4. The apparatus of claim 3 wherein a space is provided between said mode filter means and said section of microstrip circuit.

* * * * *